United States Patent [19]

Unander-Scharin

[11] Patent Number: 4,685,400

[45] Date of Patent: Aug. 11, 1987

[54] BREAK-DOWN SHELVING ASSEMBLY

[76] Inventor: Hans E. Unander-Scharin, P.O. Box 917, Wolfeboro, N.H. 03894

[21] Appl. No.: 841,163

[22] Filed: Mar. 19, 1986

[51] Int. Cl.[4] ..... A47B 47/00

[52] U.S. Cl. ..... 108/111; 108/144

[58] Field of Search ..... 108/111, 96, 106, 144, 108/153, 152, 91, 101; 211/187

[56] References Cited

U.S. PATENT DOCUMENTS

| | | | |
|---|---|---|---|
| 912,936 | 2/1909 | Cowdrey . | |
| 2,177,678 | 10/1939 | Uhri, Jr. | 108/106 |
| 2,222,160 | 11/1940 | Walsh | 108/111 |
| 2,748,954 | 6/1956 | Murren | 108/111 X |
| 2,842,270 | 7/1958 | Massey . | |
| 2,894,642 | 7/1959 | Clevett, Jr. | 108/106 |
| 2,940,601 | 6/1960 | Smith . | |
| 2,940,603 | 6/1960 | Riedmaier et al. . | |
| 2,944,780 | 7/1960 | Monk | 108/111 X |
| 2,971,657 | 2/1961 | Zadek . | |
| 3,172,376 | 3/1965 | Havlis . | |
| 3,221,678 | 12/1965 | Doherty . | |
| 3,538,862 | 11/1970 | Patriarca | 108/144 X |
| 3,747,965 | 7/1973 | Wing | 108/111 X |
| 3,961,586 | 6/1976 | Bernard | 108/111 |
| 3,965,826 | 6/1976 | Markham . | |
| 4,018,167 | 4/1977 | Spangler . | |
| 4,099,472 | 7/1978 | Kelogg | 108/111 X |
| 4,130,971 | 12/1978 | Herrig | 108/111 X |
| 4,218,979 | 8/1980 | Esposito et al. | 108/111 X |

FOREIGN PATENT DOCUMENTS

| | | | |
|---|---|---|---|
| 1037909 | 9/1978 | Canada | 108/111 |
| 1482602 | 5/1967 | France | 108/106 |
| 570087 | 12/1957 | Italy | 108/111 |

*Primary Examiner*—Peter A. Aschenbrenner
*Assistant Examiner*—José V. Chen
*Attorney, Agent, or Firm*—Kenway & Jenney

[57] ABSTRACT

A shelving structure comprising shelving connected without tools or bolts by slipping upright, hollow support pieces through holes in the shelving. T-shaped brackets are inserted through generally horizontally aligned openings in the uprights and secured by lowering a downwardly extending projection of the bracket into the hollow uprights, preferably with a close-fitting relationship. In the preferred form, the upper portion of the brackets are received into grooves on the underside of the shelves. A variety of embodiments may be constructed utilizing the same support pieces, brackets, and shelving.

9 Claims, 6 Drawing Figures

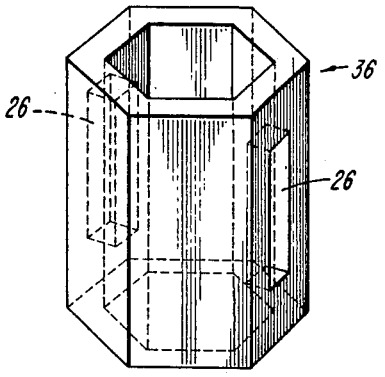
FIG. 3
FIG. 4
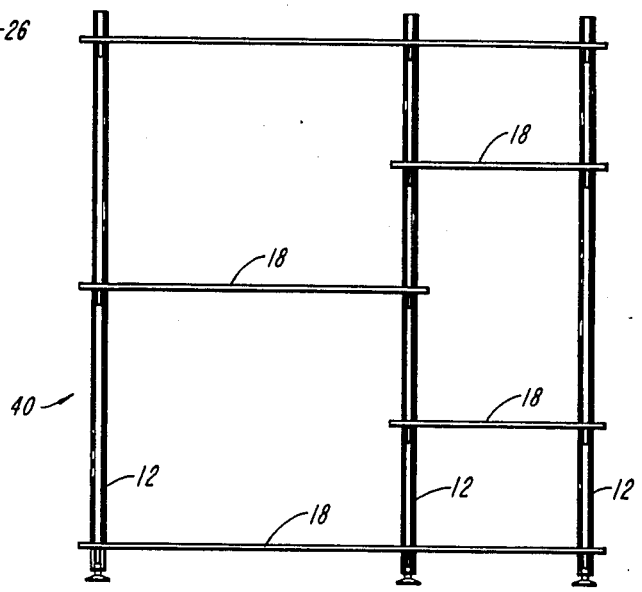
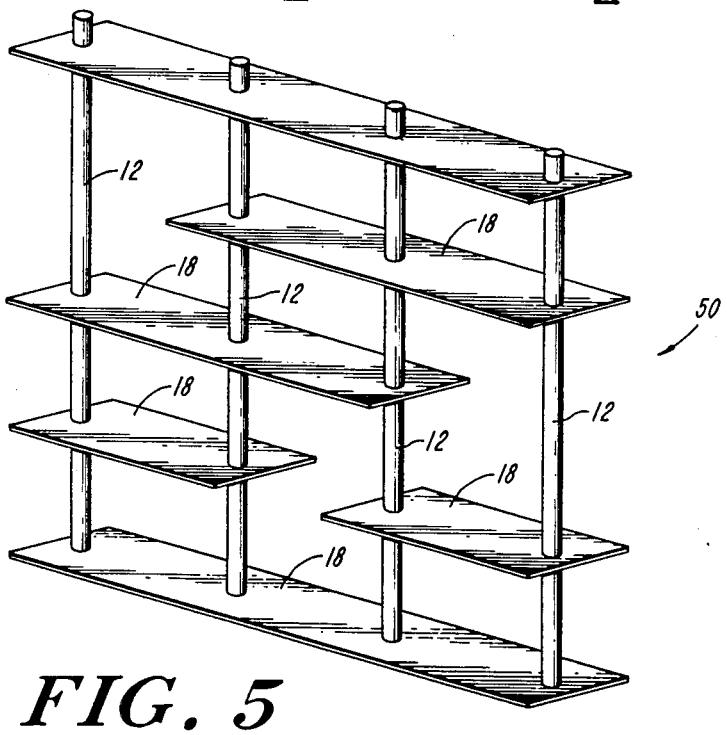
FIG. 5

BREAK-DOWN SHELVING ASSEMBLY

BACKGROUND OF THE INVENTION

This invention relates generally to shelf constructions and more particularly to a shelf structure which is assembled without bolts or tools.

A wide variety of shelving systems and brackets for attaching shelving either to wall mounted support pieces or to a conventional frame are available. Many of these are limited to only one configuration and have the further disadvantage that their assembly and disassembly requires tools, nails or bolts, and skill in assembling furniture.

A wide variety of brackets have been developed in order to provide a means for assembling shelving without the use of extraneous fasteners or tools. The brackets allow for easy and quick assembly of the shelves. Examples of brackets having hook-like projections at one end which are inserted into a slot or opening in a support piece are shown in U.S. Pat. Nos. 4,018,167 to Spangler; U.S. Pat. No. 3,965,826 to Markham; U.S. Pat. No. 2,971,657 to Zadek; U.S. Pat. No. 2,940,601 to Smith; and U.S. Pat. No. 2,940,603 to Riedmaier et al. While these brackets provide a means for supporting the shelving, they suffer from the disadvantage that the support means must be secured either to a wall or to a heavy base since the center of gravity is displaced to one side of the shelves.

Shelving support systems are available which have the means for supporting the shelves passing through the support pieces, as shown in U.S. Pat. Nos. 3,172,376 to Havlis and U.S. Pat. No. 2,842,270 to Massey. Variations of this have the shelf bracket extending around the support member. Examples are shown in U.S. Pat. Nos. 3,221,678 to Doherty and U.S. Pat. No. 912,936 to Cowdrey.

While these structures have certain advantages, none of them can be assembled without tools, bolts or nails, or a heavy base or other means for securing the structure to a separate support.

It is therefore an object of the invention to provide a free-standing, self-supporting shelving system comprising shelves, brackets, and support members which may be assembled without tools or bolts, or carpentry skills.

It is a further object of the invention that the shelving system may be easily disassembled, packaged into a small space, and lightweight enough for easy transportation.

It is a still further object of the invention to provide support for the shelves so that the structure is stable without supplemental supporting means or a heavy base.

It is another object of the invention to provide a shelving system which may be assembled in a variety of configurations.

SUMMARY OF THE INVENTION

A shelving system comprising shelves, hollow support pieces mounted in lightweight bases, and generally T-shaped brackets, wherein the support pieces extend upwardly through openings in the shelves and wherein the brackets extend horizontally through generally horizontally aligned openings in the tubular support members and have a locking portion which extends downwardly into the hollow interior of the support pieces. The locking portion is preferably in a close-fitting relationship with the interior surface of the uprights. In the preferred form, the upper surface of each bracket mates with a recess in a shelf that rests on the bracket. The shelving structure is stabilized by locating the support pieces at the centerline of the shelves. In an alternative arrangement, the support pieces are positioned off the centerline but symmetrically to obtain a balance. In this latter embodiment, the depth of the brackets on opposite sides of the locking portion may vary.

BRIEF DESCRIPTION OF THE DRAWINGS

FIG. 3 is a cross-sectional view of an alternate embodiment of a support piece for a shelving structure according to the present invention.

FIG. 4 is a plan view of a second embodiment of the shelving structure according to the present invention.

FIG. 5 is a plan view of a third embodiment of the shelving structure according to the present invention.

DETAILED DESCRIPTION OF THE INVENTION

The present invention is a shelving structure which can be easily assembled and yet is lightweight and can be packaged for easy transportation. A principal feature of the invention is the use of brackets which extend through upright support members passing through the shelves to support and secure the shelves.

Figure 1:
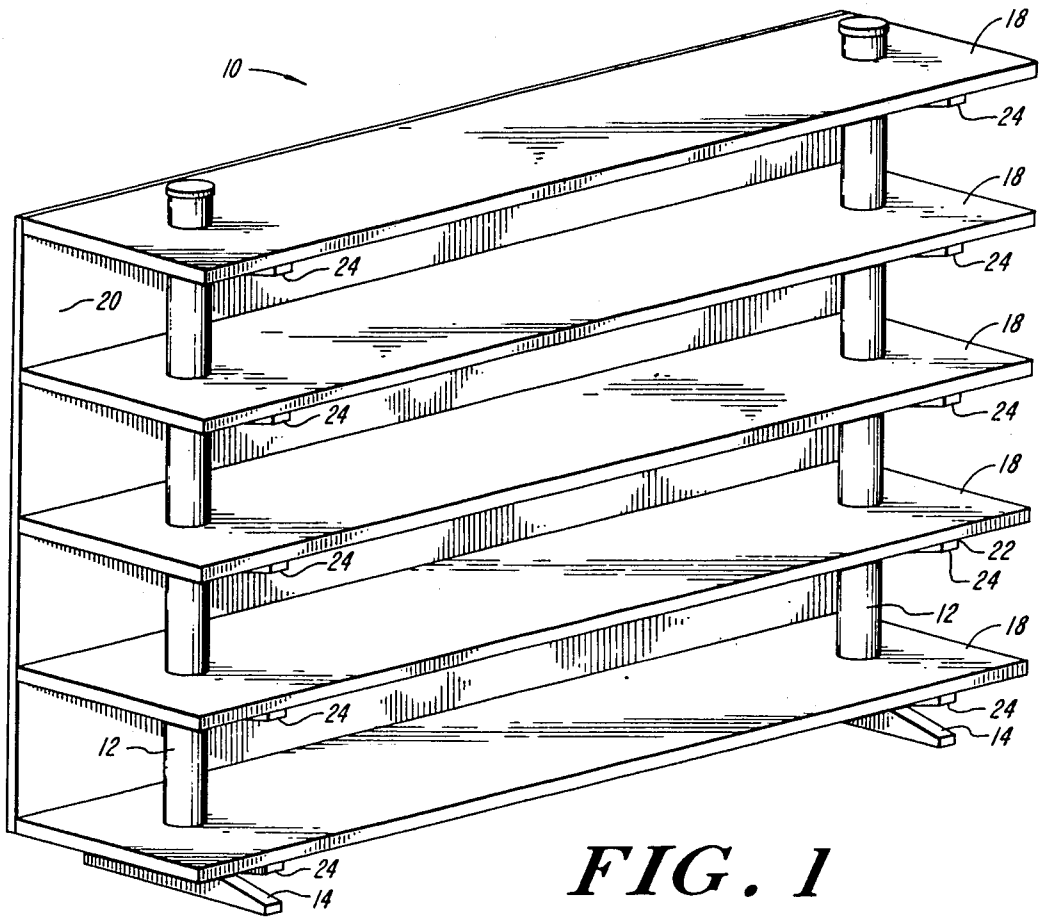
FIG. 1 is a plan view of a shelving structure according to the present invention.
Figure 2A:
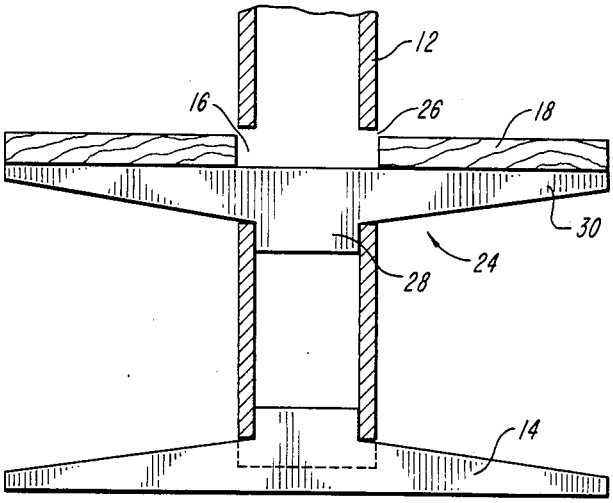
FIG. 2A and 2B are cross sectional views of the shelving brackets of FIG. 1.
Figure 2B:
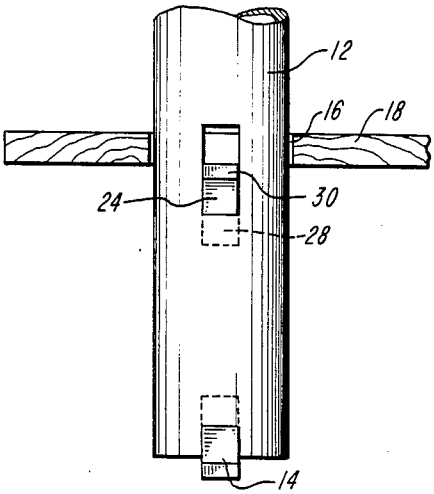

As shown in FIG. 1, a shelving structure 10 includes two upright, tubular support pieces 12 which extend upwardly from a base 14 through holes 16 in the shelves 18. The supports 12 may be threaded at a lower end to screw into mating threaded openings in the base, they may be received with a single friction fit, or any of a variety of other well-known expedients for attachment may be used. Of course, it is also possible to form the bases 14 and associated supports 12 as integral members, although this will ordinarily present a higher cost of manufacture and may be less convenient for shipping. In any event, the bases 14 are comparatively lightweight, having sufficient length and structural strength to stabilize the shelving against a front and back tilting movement. Optionally, backing 20 may be attached to the structure to provide further stability and aesthetic appeal. The bottom of the shelves 18 have grooves 22 which extend from the front to the back of the shelves 18. Brackets 24, shown more clearly in FIG. 2A and 2B, fit into these grooves 22 to more firmly secure the shelves against any twisting movement.

The brackets 24 extend through a pair of horizontally aligned openings 26 on each side of the hollow support piece 12. The bracket 24 is generally T-shaped, with a locking projection 28 which extends downwardly from the cross piece 30 of the bracket 24. The opening 26 extends upwardly a distance of at least the height of the cross piece 30 plus the length of the projection 28. The width of the opening 26 is equal to at least the width of the bracket 24.

Although the embodiments shown in the drawings utilize tubular support pieces 12, multi-sided hollow upright structures such as the piece 36 shown in FIG. 3 may be used. Pieces with a square or rectangular cross-sectional area may also be used, as long as there are horizontally aligned openings 26 sufficient to allow insertion of the bracket 24 through the support piece and the bracket can be secured within the support piece. In the preferred embodiment, the projection 28 has a square or rectangular shape and is constructed to fit securely within the tubular support pieces 12. Other shapes may be utilized as long as there are sufficient points of contact between the projection and the support pieces to form a close fitting relationship between the support pieces and the bracket.

Variations of the structure shown in FIG. 1 are formed by selecting shelves of different lengths and arranging them on three or more support pieces. The shelves may be of any length or width, although the width and length should not be so great that the assembled structure is wobbly or weak in the middle of the shelves. The shelves may be constructed of any strong material such as metal, wood or plastic. The appearance of the shelves may be varied by application of wall coverings or laminates.

The holes in the shelving are preferably positioned at the centerline of the shelves, halfway between the front and back of the shelves. This configuration provides the greatest stability since the center of gravity is directly over the support pieces. However, the widths of the shelves and the location of the holes can be varied, for example, when support pieces are alternately located towards the front and towards the back of the shelves, as shown in FIG. 4. The holes should be dimensioned to form a close fitting relationship around the support pieces. This centering of the mass of the assembled shelving facilitates the use of a comparatively lightweight base 14 as compared to certain prior art structures where the weight of the base is important to the stability of the structure.

The brackets are designed to provide for rapid, tooless assembly and disassembly. The openings are made to closely conform to the dimensions of the inserted brackets, to the extent possible. Since the shelves rest on the bracket, the shelf can be used to cover the upper portion of the opening, equal to the depth of the central downwardly extending projection, required for the bracket to fit into the support piece. The brackets can be formed of metal, wood or plastic, from one or more pieces of material. Optionally, the underside of the shelves may contain grooves complementary to the cross-pieces of the T-shaped brackets. When the shelves are positioned on the brackets, the brackets are retained within those grooves so that the shelves cannot rotate around the support pieces.

Examples of alternate embodiments are shown in FIGS. 4 and 5. In the second embodiment 40 shown in FIG. 4, three support pieces 12 are connected by means of shelves 18 of various lengths. In the embodiment 50 shown in FIG. 5, four support pieces 12 are connected by shelving 18 of various lengths. These embodiments demonstrate the flexibility of the system.

The shelving structure may be mounted on a variety of bases. Unlike the prior art shelving, as noted above, it is not necessary to have a heavy base or vertical support structure to one side of the shelves. In the embodiment shown in FIG. 1, the base 14 extends perpendicularly outward from the center line of the shelves 18. In another variation, shown in FIG. 5, the hollow supports 12 are inserted into a shelf and secured against vertical or lateral movement. The support pieces 12 may be pinned or the brackets 24 inverted and rested against the upper portion of the shelf to prevent the shelving assembly from tilting. In still another variation, a bracket 24, turned in reverse from its usual vertical orientation, is received in the open bottom end of a support piece 12 and the bracket surface that would otherwise support a shelf rests on the ground. Other variations will occur to those skilled in the art.

Some principal advantages of the invention are the ease of assembly and the fact that the entire structure may be disassembled and packaged into a small space for ease in transporting. Further, the system can be assembled in a variety of designs and construction materials. Construction and assembly ca be designed to range from expensive to very inexpensive.

Variations and other embodiments of the shelving structure of the present invention will occur to those skilled in the art from the foregoing detailed description and accompanying drawings. Such modifications and variations are intended to fall within the scope of the appended claims.

What is claimed is:

1. Shelving structure comprising:

a plurality of hollow, upright support members;

at least one shelf extending horizontally in a first direction;

a plurality of T-shaped brackets each having a cross member and a central, downwardly projecting locking portion;

wherein said shelves have openings into which the support members are inserted in a close fitting relationship;

wherein said support members have horizontally aligned openings with dimensions equal to at least the width and maximum height of said brackets located at spaced intervals along said support members;

said brackets and openings being configured, located and dimensioned so that said brackets are inserted with a lateral movement into said horizontally aligned openings with said downwardly projecting locking portion positioned within said support piece following said lateral insertion; thereafter, the bracket is moved downwardly so that the locking portion fixedly engages the support member and said shelves resting on said brackets.

2. The shelving structure of claim 1 further comprising grooves extending along the underside of said shelves in a direction transverse to said first direction and lying in the plane of said shelf which grooves are complementary to the cross member of said T-shaped brackets.

3. The shelving structure of claim 1 wherein said support members have a circular cross section.

4. The shelving structure of claim 1 wherein said support mombers have a multisided cross section.

5. The shelving structure of claim 1 wherein said openings in said shelves are located near the center of said shelves measured along the perpendicular to said first direction.

6. The shelving structure of claim 1 comprising two support members and shelves of equal length.

7. The shelving structure of claim 1 comprising more than two support pieces and shelves of different lengths.

8. The shelving structure of claim 1 wherein said shelves are of different widths.

9. The shelving structure of claim 1 wherein said openings are displaced from the centerline of said shelves where said centerline extends along said first direction and is midway along a perpendicular to the first direction lying in the plane of said shelf.

* * * * *